United States Patent [19]

Klaus

[11] 4,096,603

[45] Jun. 27, 1978

[54] DRAWER PULL AND LABEL HOLDER

[75] Inventor: Gerald R. Klaus, St. Charles, Ill.

[73] Assignee: Fellowes Manufacturing Company, Franklin Park, Ill.

[21] Appl. No.: 737,715

[22] Filed: Nov. 1, 1976

[51] Int. Cl.[2] ..... A47B 95/02; B65D 5/46; B65D 25/28

[52] U.S. Cl. ..... 16/110 R; 16/114 R; 229/52 A; 229/52 AM

[58] Field of Search ..... 16/110 R, 114 R; 229/52 A, 52 AM

[56] References Cited

U.S. PATENT DOCUMENTS

| | | | |
|---|---|---|---|
| 2,611,530 | 9/1957 | George | 229/52 AM |
| 2,723,073 | 11/1955 | Fellowes | 16/110 R |
| 3,212,123 | 10/1965 | Southcott | 16/114 R |
| 3,509,592 | 5/1970 | Schrock | 16/110 R |

*Primary Examiner*—Louis K. Rimrodt
*Attorney, Agent, or Firm*—Roy E. Hofer; Joan I. Norek

[57] ABSTRACT

A detachable pull and label holder for a drawer front panel includes a U-member and a pull means and label holder means on the outer surface of one leg thereof. A suitable drawer front panel is multi-layered with the outermost layers attached or secured at the upper end and a suitable drawer has an opening in the bottom near the front panel providing a bottom edge to the front panel around which the U-member is positioned. The leg positioned on the inside of the panel engages the inner layer.

3 Claims, 4 Drawing Figures

FIG. 1
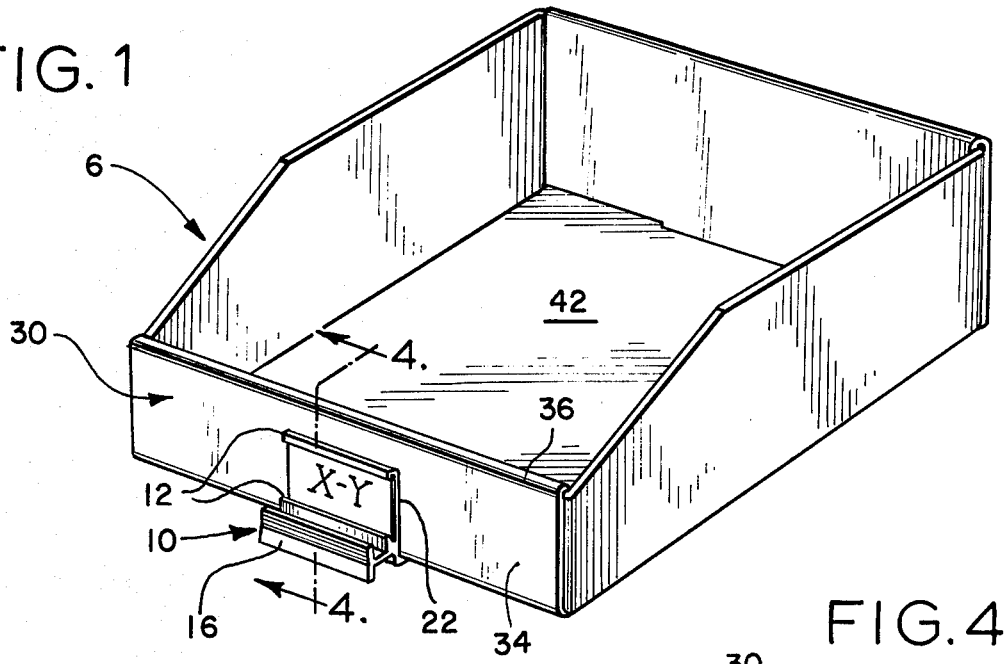
FIG. 2
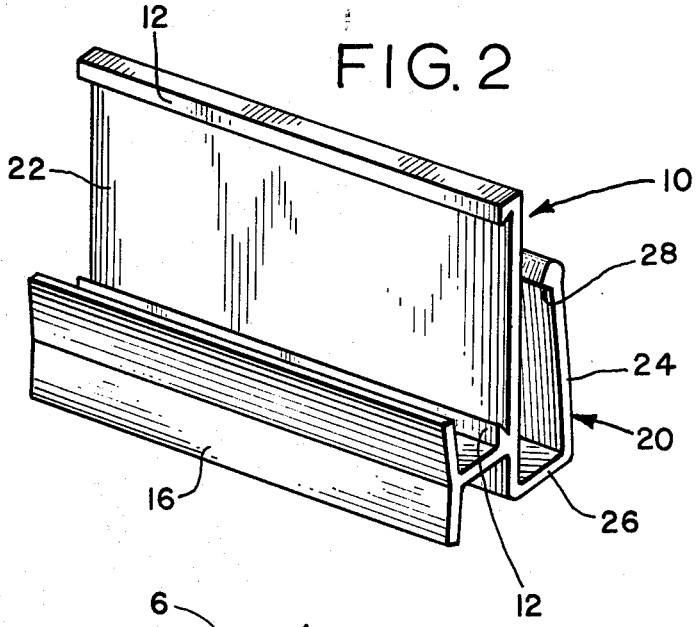
FIG. 4
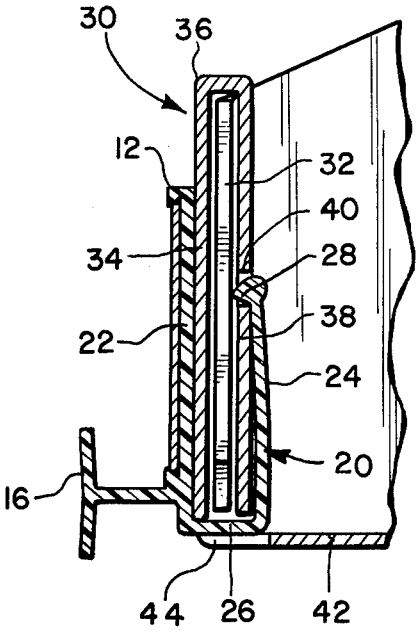
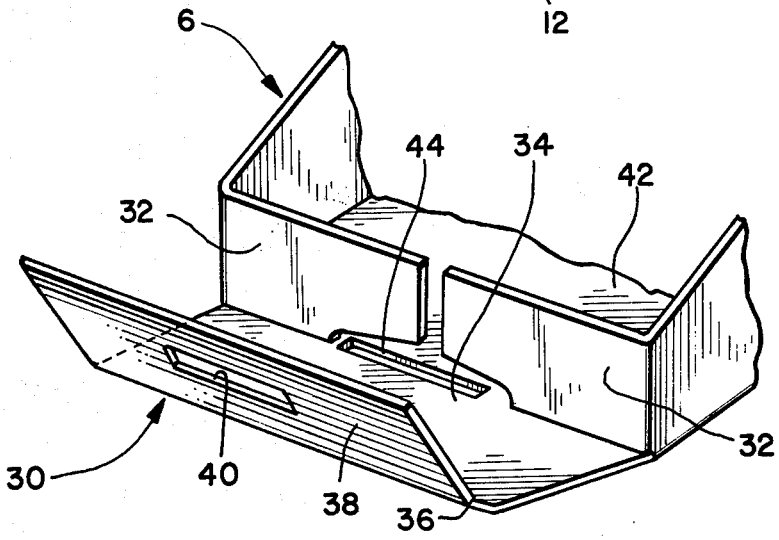
FIG. 3

DRAWER PULL AND LABEL HOLDER

BACKGROUND OF THE INVENTION

The present invention is directed toward a detachable drawer pull or a combination drawer pull and label holder for a drawer front panel or the like. Single units which combine a pull (handle) which can be grasped by hand to slide a drawer outwardly or inwardly with a structure designed to display a card or the like on which the contents of the drawer are labeled are advantageously utilized on drawers of file cabinets or other storage compartments frequently used in offices. Devices combining structures for grasping by hand and holding labels are exemplified in U.S. Pat. Nos. 3,238,656 (Kanzelberger) and 3,300,887 (Cafiero).

Offices which store large volumes of records often find it advantageous, if not necessary, to use lightweight, easily assembled storage units made of corrugated fiberboard, instead of rigid file cabinets made of metal or wood which often are not easily assembled or disassembled and are relatively heavy and therefore not easily moved.

Filing cabinets and drawers constructed of lightweight materials such as corrugated fiberboard are now being extensively used for storage of records. Cabinets constructed of such material are usually easy to assemble and disassemble. Flexible construction materials that are foldable permits collapsible unit designs. When the cabinets and drawers are assembled, the flexible materials are sufficiently rigid to support the weight of the materials being stored within. This type of collapsible cabinet drawer is contemplated for advantageous use in conjunction with the drawer pull of the present invention.

It is important that collapsible drawers be so assembled that their integrity is maintained during use. It is often also important that such drawers be disassembled easily so that full advantage of the mode of construction may be realized.

A drawer pull or label holder suitable for use with such a drawer is advantageously constructed of a rigid durable material. For convenient assembly and disassembly of the drawer, it is necessary that the rigid drawer pull be easily attached to and detached from the drawer panel and yet cannot be accidentally dislodged during use of the drawer.

Drawer pulls detachably secured to drawers by means of a U-shaped member which is slid over an edge of the drawer structure are known in the art. Such type of devices are secured in their position by various means, such as by teeth which engage the adjacent drawer surface (U.S. Pat. Nos. 3,107,389 and 3,509,592) or conventional methods such as screws (U.S. Pat. No. 3,238,656). Such securing means function only to attach the drawer pull to the drawer panel and do not function in any manner to additionally maintain the integrity of the drawer panel itself.

The general object of the invention is to provide a detachable drawer pull or drawer pull and label holder including a means for detachably securing the pull and label holder to a drawer panel while holding the layers of the drawer panel together to maintain the drawer panel's integrity. A further object is to provide a drawer pull or drawer pull and label holder that when detached from the drawer panel allows the panel to be at least in part collapsed. A further object to provide a means for securing a drawer pull and label holder which means facilitates assembly of the drawer panel to which it is being attached.

SUMMARY OF THE INVENTION

These and other objects are accomplished by the present invention which provides a detachable drawer pull or drawer pull and label holder combination for a partially collapsible drawer which pull is an integral unit easily attached to and detached from the drawer. The present invention further provides an improved drawer pull or drawer pull and label holder combination which is an integral unit with means not only for securing the device to a drawer panel but also for maintaining the integrity of such drawer panel. The present invention provides a means for attaching a drawer pull to a collapsible drawer panel and maintaining the drawer panel in an assembled position, which means can easily be disengaged allowing the drawer pull to be removed from the panel and allowing the panel to be disassembled.

In accordance with the present invention this is achieved by providing a drawer pull unit with a U-shaped member which is adapted to be positioned around the edge of a drawer panel with the two legs of the U-shaped member positioned adjacent to the outer and inner sides of the panel, respectively. A pull means capable of being grasped by hand is positioned on the outer surface of the outer positioned leg which optionally may also support a label holder means. The type of drawer panel to which this drawer pull unit may be attached has at least two layers: the innermost layer connected to the outermost layer at its edge opposite the panel edge around which the U-member is inserted. The innermost panel layer contains an opening which when in an assembled position forms a slot. The leg of the U-member abutting such inner layer includes a means for engaging the slot, thereby securing the drawer pull unit to the drawer panel, and also preventing movement of said innermost and outermost layers in opposite directions.

DESCRIPTION OF THE DRAWINGS

FIG. 1 is a perspective view of a drawer upon which is mounted a pull and label holder combination embodying present invention;

FIG. 2 is a perspective view of the drawer pull and label holder combination and securing means;

FIG. 3 is a perspective view of a drawer whose front panel is disassembled; and FIG. 4 is a transverse sectional view along line 4.4 of the drawer pull and label holder combination fastened to an assembled front panel of a drawer.

DETAILED DESCRIPTION OF THE INVENTION

With reference to the drawings, there is shown in FIG. 1 a drawer, designated generally by the numeral 6, constructed of corrugated cardboard with a collapsible front panel 30 upon which is mounted a drawer pull and label holder unit 10 embodying the features of the present invention. The drawer pull and label holder 10 is not only detachably secured to the front panel 30 without the use of any conventional mounting means but also holds the layers of the front panel 30 together maintaining its integrity.

Referring now to all the Figures, the pull and label holder combination unit 10 includes a U-member designated generally by the numeral 20. Said U-member 20 includes a first leg member 22, a second leg member 24 and a bottom member 26 interconnecting the leg members 22 and 24 at their lower ends. A label holder means 12 and a pull means 16 are positioned on the outer surface of the first leg member 22. The leg members 22 and 24 are shown in substantial parallel alignment being spaced apart a suitable distance so as to be positioned adjacent to the sides of a panel 30 when inserted over an edge thereof.

The drawer pull means 16 is depicted as a T-member extending perpendicularly to the first leg member as best seen in FIG. 4. When the unit 10 is secured to an assembled drawer panel, the T-member 16 is positioned to extend outwardly away from the front of the drawer panel. The drawer pull means 16 however may be any shape convenient for grasping by hand which shapes are well known to those with ordinary skill in the art. The invention is not limited to a T-shaped pull means and selection of a suitable pull means is within the skill of one with ordinary skill in the art.

The end of the second leg member 24 includes a projection or flange 28 on its inner surface. This flange 28 engages the inside layer of the drawer front panel 30 when assembled as best shown in FIG. 4. The inner surface of the first leg 20 however is substantially flat as is the outer surface of the bottom member 26, to provide contact with the compartment substantially coextensive with these surfaces.

The drawer front panel 30 is constructed of several layers. As best shown in FIG. 3 wherein the drawer front panel 30 is illustrated in its disassembled form, the panel 30 includes two flaps 32, which are extensions of the drawer sides and two panel layers 38, 34 which together compose a length of material which is an extension of the drawer bottom 42. The two panel layers 38, 34 are defined by a crease or folding edge 36 whereby the two panel layers 38, 34 are folded over the flaps 32 positioning one layer 38 inwardly and the other layer 34 outwardly of the drawer front panel 30. The innermost layer 38 contains a slot 40 which the flange 28 on the second leg member 24 will engage when assembled as shown in FIG. 4.

An opening 44 extending at least the length of the drawer pull and label holder 10 is located in the drawer bottom 42 and is positioned so as to receive the second leg member 24 of the unit.

The label holder means 12 retain a card or label against the outer surface of the first leg member 22. The label holder means 12 is illustrated as opposed flanges which form upper and lower grooves to hold a card or label, however the present invention includes any convenient label holder means, the selection of which is within the ordinary skill of one in the art.

The drawer pull and label holder unit 10 can easily be secured by sliding it over the edge provided by the opening 44 and the innermost and outermost layers 38, 34 of the drawer panel when in a folded position until the flange 28 of the second leg member 24 engages the slot 40. When thus assembled, the drawer 6 is movable forward and backward when force is exerted such as by grasping the pull means 16 and pulling or pushing the drawer. The drawer pull and label holder unit 10 is so secured to the drawer that such force will not dislodge the unit from the drawer panel 30. Moreover, the drawer front panel 30 is prevented from accidental disassembly, the outermost and innermost layers 38, 34 being held aligned in substantially parallel positions by the U-shaped member 20.

The drawer pull and label holder unit 10 can be constructed of any material that has sufficient rigidity to secure the layers of drawer front panel and yet have some flexibility to allow the attachment or detachment from the panel. A preferred material is synthetic plastic of medium density.

It should be understood that the drawer pull or drawer pull and label holder unit 10 of the present invention may be adapted for advantageous use with drawers constructed from virtually any material that is either foldable or so hinged as to provide an outer layer connected to the drawer bottom and an inner layer connected to the outer layer at the top of the assembled panel.

I claim:

1. A detachable drawer pull for a collapsible front panel of a drawer which panel includes an outermost and innermost layer hinged together along a first edge of the panel, and said outermost layer being an extension of the bottom of said drawer along a second edge of said panel opposite said edge and said drawer having an opening adjacent said second panel edge, comprising:

a generally U-shaped member including first and second leg members and a bottom member, said U-shaped member being adapted to be slid into said opening adjacent said second edge of a drawer panel front opposite said hinged edge so that the first and second leg members are adjacent to the outer and inner layers of the panel, respectively, said bottom member having a substantially flat outer surface and said first leg member having a substantially flat inner surface;

pull means positioned on the outer surface of said first leg member, extending perpendicular thereto;

label holder means positioned on the outer surface of said first leg member; and a flange adapted to engage a slot on the inner layer of the drawer front panel on said second leg member.

2. The drawer pull of claim 1 wherein the pull means is a T-member extending perpendicularly from said first leg member.

3. The drawer pull of claim 2 wherein said first leg member is of greater length than said second leg member.

* * * * *